United States Patent [19]

Cavalieri D'Oro

[11] 4,188,600

[45] Feb. 12, 1980

[54] CAVITY RESONATOR HAVING ANCILLARY CYLINDER FOR SUPPRESSING PARASITIC MODE

[75] Inventor: Enzo Cavalieri D'Oro, Monza, Italy

[73] Assignee: Società Italiana Telecomunicazioni Siemens S.p.A., Milan, Italy

[21] Appl. No.: 863,623

[22] Filed: Dec. 23, 1977

[30] Foreign Application Priority Data

Dec. 24, 1976 [IT] Italy ..... 30852 A/76

[51] Int. Cl.[2] ..... H01P 1/16; H01P 706

[52] U.S. Cl. ..... 333/228; 333/251

[58] Field of Search ..... 333/83 A, 98 M, 228, 333/251

[56] References Cited

U.S. PATENT DOCUMENTS

| | | | |
|---|---|---|---|
| 2,500,417 | 3/1950 | Kinzer | 333/83 A |
| 2,593,155 | 4/1952 | Kinzer | 333/83 A |
| 2,593,234 | 4/1952 | Wilson | 333/83 A |
| 2,632,806 | 3/1953 | Preston | 333/98 M X |
| 3,899,759 | 8/1975 | Hines et al. | 333/98 M X |

*Primary Examiner*—Paul L. Gensler

*Attorney, Agent, or Firm*—Karl F. Ross

[57] ABSTRACT

A conductive body with a cylindrical cavity, designed to resonate at a certain operating frequency in the $TE_{01}$ mode, has an input opening at one end and a conductive insert at the opposite end which alters the effective axial length for parasitic waves propagated in the $TM_{11}$ mode. The insert may have the form of a smaller cylinder with a closed end beyond that of the main cavity, increasing the effective length, or of a set of radial vanes reducing the effective length. The insert, in either case, may be axially shiftable to tune the cavity to different resonant frequencies.

5 Claims, 6 Drawing Figures

CAVITY RESONATOR HAVING ANCILLARY CYLINDER FOR SUPPRESSING PARASITIC MODE

FIELD OF THE INVENTION

My present invention relates to a cavity resonator designed to control the transmission of microwaves in an associated waveguide, especially for the selective suppression of a certain frequency in a filter network.

BACKGROUND OF THE INVENTION

In my copending application Ser. No. 863,624 of even date there has been disclosed a low-pass or band-pass microwave filter with a multiplicity of cascaded sections or cells each having a parallel-resonant series arm. Such a cavity resonator is frequently designed as a hollow cylindrical body of conductive material with an inlet for coupling its cavity to an associated guide path and with a substantially closed opposite end, allowing microwaves to propagate in the cavity in the mode $TE_{01}$ which minimizes the insertion loss. As is well known, the lines of current flow in the $TE_{01}$ mode lie in planes perpendicular to the axis of a cylindrical cavity or waveguide; in an alternate mode $TM_{11}$ these current lines lie in planes parallel to the axis.

Conventional cavity resonators of the aforedescribed type, when excited in the $TE_{01}$ mode, also give rise to the parasitic $TM_{11}$ mode. With the cavity resonating at the same frequency in both modes, the frequency-selective quality of the resonator is impaired. It is therefore customary to provide means in such a cavity for reducing the proportion of wave energy propagating in the $TM_{11}$ mode in favor of the preferred $TE_{01}$ mode. This is conventionally accomplished by inserting into the cavity cylinder a conductive piston of smaller diameter spaced from its wall, with interposition of energy-absorbing loss material between the piston and the closed end of the cavity. As the loops of the axially extending lines of current in the $TM_{11}$ mode are closed through the loss material, that mode is weakened.

Such a construction involves certain technical problems and adds rather considerably to the cost of the filter while also imposing restrictions on the designer. Moreover, especially with high powers in the kilowatt range, even the small percentage of absorbed energy may cause an inadmissible increase in temperature.

Other conventional solutions to the stated problem involve the provision of radially extending screws or other conductive projections on the inner cavity wall for the purpose of distorting the magnetic field of the parasitic mode or modes without significantly affecting the desired principal mode. Such a cavity is generally tuned to a fixed resonance frequency.

OBJECTS OF THE INVENTION

The general object of my present invention is to provide an improved cavity resonator of the aforedescribed type which effectively suppresses the parasitic $TM_{11}$ mode and operates with a low insertion loss in the favored $TE_{01}$ mode.

A more particular object is to provide means in such a resonator for facilitating its tuning to different operating frequencies.

SUMMARY OF THE INVENTION

In accordance with my present invention I provide a conductive insert in the cylindrical cavity body, in the vicinity of its closed end, for establishing effective different axial lengths for the favored $TE_{01}$ mode and for the parasitic $TM_{11}$ mode to resonate the cavity only in the mode $TE_{01}$ at a selected operating frequency. The resonance frequency for mode $TM_{11}$, thanks to the altered effective length, is well separated from that operating frequency and advantageously lies outside the frequency band capable of being propagated in the $TE_{01}$ mode.

BRIEF DESCRIPTION OF THE DRAWING

The above and other features of the invention will now be described in detail with reference to the accompanying drawing in which.

SPECIFIC DESCRIPTION

Figure 1:
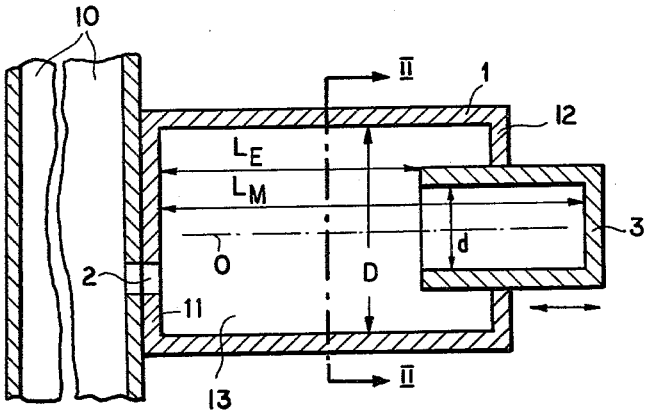
FIG. 1 is an axial sectional view, taken on the line I—I of FIG. 2, of a cavity resonator according to my invention, coupled to an associated waveguide.

In FIG. 1 I have illustrated a signal path 10, i.e. a waveguide of the usual rectangular cross-section, serving for the transmission of microwaves in a frequency band including a certain frequency to be selectively suppressed. A cavity resonator according to my invention comprises a cylindrical metallic body 1 centered on an axis 0 perpendicular to that of the guide, this body having an end wall 11 with an aperture 2 by which it is coupled to the guide 10. Body 1 forms a resonant cavity 13 and has a closed end 12 opposite the one formed with coupling aperture 2.

In accordance with my invention, an ancillary conductive cylinder 3 of inner diameter d, substantially smaller than the inner cavity diameter D, is inserted into the closed end 12 so as to extend the effective length of the cavity for waves capable of propagating at the selected operating frequency in the $TM_{11}$ mode within cylinder 3. Since the cylinder 3 will not sustain waves in the $TE_{01}$ mode at that operating frequency, the effective length of the cavity for this favored mode is reduced to a distance $L_E$ measured between wall 11 and the confronting face of cylinder 3. On the other hand, the effective length $L_M$ for the parasitic $TM_{11}$ mode is measured from wall 12 to the closed bottom of cylinder 3 and is therefore considerably greater than length $L_E$.

Figure 2:
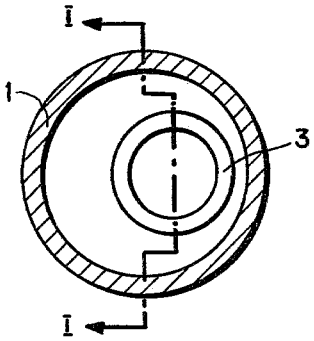
FIG. 2 is a cross-sectional view taken on the line II—II of FIG. 1.

Ancillary cylinder 3 is not necessarily centered on the cavity axis 0 but may be radially offset therefrom, as illustrated in FIG. 2.

Figure 5A:
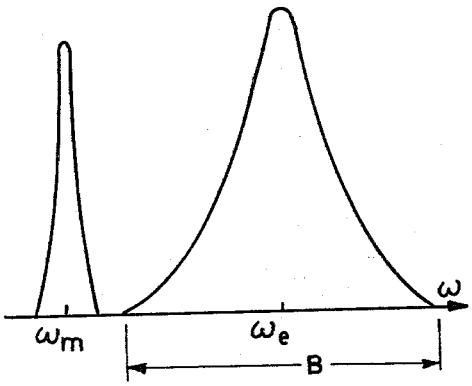
FIG. 5A is a graph showing the response characteristic of the cavity resonator illustrated in FIGS. 1 and 2.

By suitably dimensioning the cylinder 3, in a manner well known per se, I can establish an angular resonance frequency $\omega_M$ for the $TM_{11}$ mode well below the pass band B of the resonator, i.e. the group of frequencies capable of propagating in cavity 13 in the $TE_{01}$ mode, that band including the angular resonance frequency $\omega_E$ for the $TE_{01}$ mode as illustrated in FIG. 5A. The diameter d of cylinder 3 should be small enough to prevent propagation of mode $TE_{01}$ but sufficient to let most of the parasitic energy of mode $TM_{11}$ enter that cylinder. The limiting values for diameter d are given by $$1.841 \frac{\lambda}{\pi} < d < 3.832 \frac{\lambda}{\pi}$$

where λ is the free-space wavelength at angular frequency $\omega_E$.

Figure 3:
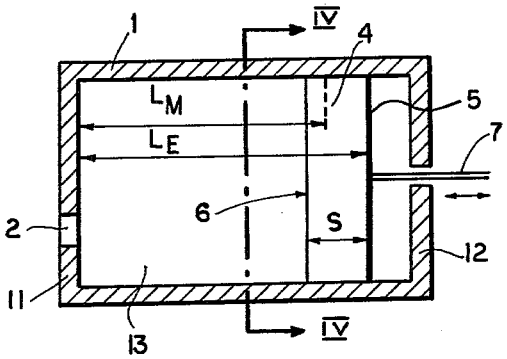
FIG. 3 is a view similar to FIG. 2, taken on the line III—III of FIG. 4 and representing another embodiment.
Figure 4:
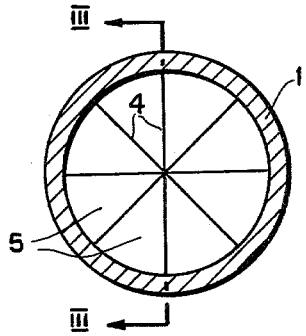
FIG. 4 is a cross-sectional view taken on the line IV—IV of FIG. 3.

In FIGS. 3 and 4 I have shown a conductive insert 6 consisting of a set of sheet-metal vanes 4 radiating in different directions, here specifically 45° apart. Since these vanes lie in axial planes of body 1, they absorb a significant part of the wave energy propagating in the $TM_{11}$ mode so that the effective length $L_M$ of the cavity for this mode is foreshortened to slightly more than the distance between wall 11 and the confronting face of insert 6. The latter has a conductive back wall 5 that forms a false bottom for cavity 1 and limits the effective length $L_E$ which exceeds the length $L_M$ by almost the axial width s of the vanes 4. A stem 7 rigid with insert 6 enbles the adjustment of both lengths $L_M$ and $L_E$; such adjustment is also possible in the preceding embodiment by an axial shifting of cylinder 3.

Figure 5B:
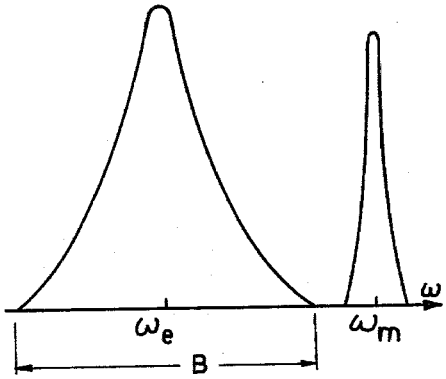
FIG. 5B is a graph similar to FIG. 5A but relating to the embodiments of FIGS. 3 and 4.

By suitable choice of web width s I can again establish an angular frequency $\omega_M$ outside the pass band B, in this case above the latter, as illustrated in FIG. 5B.

As is known, length $L_E$ corresponds to half a wavelength at the resonance frequency of the cavity.

I claim:

1. A cavity resonator comprising:

a hollow cylindrical body of conductive material forming a resonant cavity provided at one end with an inlet for coupling said cavity to a guide path traversed by microwaves of a predetermined operating frequency, said cavity being substantially closed at its opposite end; and a solid ancillary conductive cylinder of smaller inner diameter than said cavity inserted into said opposite end, said cylinder being provided with an open end confronting said inlet and with a closed end farther from said inlet than said opposite end, said cavity being dimensioned to sustain a preferred mode of propagation for microwaves in a frequency band centered on said operating frequency, the inner diameter of said ancillary cylinder being less than that required for the propagation of waves at said operating frequency in said preferred mode while facilitating such propagation in a parasitic mode.

2. A cavity resonator as defined in claim 1 wherein said ancillary cylinder has an axial length enlarging the effective length of said cavity for waves propagated in said parasitic mode to an extent sufficient to establish a resonance frequency for said parasitic mode below said frequency band.

3. A cavity resonator as defined in claim 1 wherein the inner diameter of said ancillary cylinder ranges between 1.841 $\lambda/\pi$ and 3.832 $\lambda/\pi$ where λ is the free-space wavelength at said operating frequency.

4. A cavity resonator as defined in claim 1 wherein said ancillary cylinder is axially shiftable in said cavity relative to said opposite end for tuning said cavity to different operating frequencies.

5. A cavity resonator as defined in claim 1 wherein said ancillary cylinder has an axis parallel to but offset from the axis of said cavity.

* * * * *